United States Patent [19]

Hashimoto et al.

[11] Patent Number: 4,483,527

[45] Date of Patent: Nov. 20, 1984

[54] SHEET MATERIAL HANDLING DEVICE

[75] Inventors: Takeji Hashimoto, Nagaoka; Osami Umemoto, Kyoto, both of Japan

[73] Assignee: Dainippon Screen Seizo Kabushiki Kaisha, Japan

[21] Appl. No.: 491,888

[22] Filed: May 5, 1983

[30] Foreign Application Priority Data

Jun. 15, 1982 [JP] Japan ..... 57-102369

[51] Int. Cl.[3] ..... B65H 5/22

[52] U.S. Cl. ..... 271/5; 271/98; 271/107; 353/113; 414/32

[58] Field of Search ..... 271/5, 3, 4, 11, 14, 271/107, 105, 98, DIG. 9, 15; 414/121, 32; 353/113, 118, DIG. 1

[56] References Cited

U.S. PATENT DOCUMENTS

| | | | |
|---|---|---|---|
| 1,331,977 | 2/1920 | Bieri | 271/98 |
| 1,578,822 | 3/1926 | Glover | 271/11 |
| 3,584,868 | 6/1971 | Fromm et al. | 271/14 X |
| 4,131,273 | 12/1978 | Kufrin et al. | 271/4 |
| 4,212,263 | 7/1980 | Hillhouse | 271/5 X |

*Primary Examiner*—Duane A. Reger
*Assistant Examiner*—John A. Carroll
*Attorney, Agent, or Firm*—Ostrolenk, Faber, Gerb & Soffen

[57] ABSTRACT

Disclosed is a sheet handling device comprising an unprocessed sheet material storage box, a processed sheet material storage box located therebelow, and a suction device which may be telescopically moved between the sheet material storage boxes and a work table onto and from which the sheet material is to be fed and taken out by means of suction cups provided on the lower surface of the suction device. To keep the state of the sheet material in transit under control, a plurality of nozzles are provided along the suction cups for blowing air along the sheet material. Since the two sheet material storage boxes are arranged one over the other and there is no rail extending over the work table, very little floor space is taken up and the work performed on the work table is not hindered by the sheet handling device.

5 Claims, 5 Drawing Figures

SHEET MATERIAL HANDLING DEVICE

This invention relates to a device for handling sheet material and in particular to such a device which occupies very little floor space and is adapted to be used in association with a sheet processing machine such as an automatic drafting machine by not interfering therewith.

Conventionally, handling of sheet material, in particular, feeding and taking out of sheet material, has been performed by hand and it has been causing a great obstacle to the automatization of sheet processing machines, such as photographic cameras, photographic printers, plastic sheet cutter, automatic drafting machines and so on in which feeding and taking out of sheet material is an indispensable part of their work. Therefore, such sheet material processing machines were usable only in normal working time during which the necessary manual labor is available although such machines are sufficiently automatized to be employed for a long time period without any other human attendance.

To circumvent this inconvenience in the handling of sheet material, there has been proposed an automatic sheet material handling machine for feeding and taking out an original plate or a printing plate in an automatic photographic printer, but such a machine tends to be bulky as it generally requires the use of a rail for conveying the sheet material and, when it is used in association with an automatic drafting machine, the rail tends to obstruct the action of the automatic drafting machine.

In view of such shortcomings of conventional devices for handling sheet material, a primary object of this invention is to provide a device for handling sheet material which is free from the above-described inconveniences and shortcomings.

Now the present invention is described in the following in terms of a concrete embodiment with reference to the appended drawings, in which.

Figure 1:
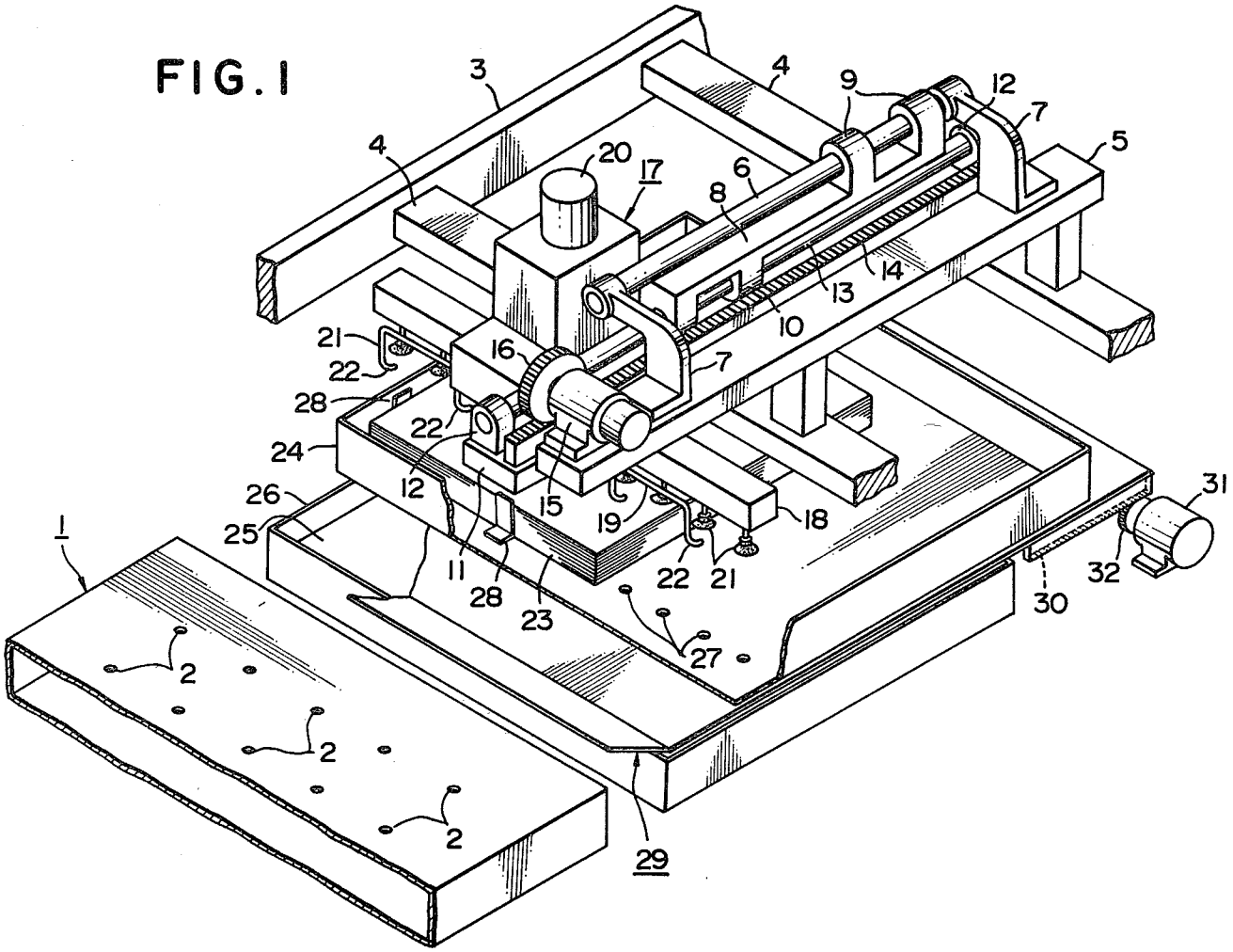
FIG. 1 is a perspective view of the device of this invention.

In FIG. 1, numeral 1 denotes a table of an automatic drafting machine in connection of which the device of this invention is intended to be utilized. This table 1 is provided with a multiplicity of vaccum suction holes 2 for intimately securing sheet material thereover.

A pair of support rods 4 and 4, which are fixedly secured to stationary members 3 (only one of which is shown in FIG. 1) extending in the direction along which the sheet material is to be conveyed, support a support plate 5 which also extends in the same direction.

On the support plate 5 is mounted a first spline shaft 6 by way of a pair of support brackets 7 and 7 so as to extend longitudinally above a side end of the support plate 5. The first spline shaft 6 further passes through a pair of linear bearings 9 and 9 which are integrally formed on the upper surface of the rear end of a first slide block 8 while a pair of similar linear bearings 10 and 10 formed on the lower surface of the same slide block 8 accommodates slidably therethrough a second spline shaft 13 which is supported on the upper surfaces of the both ends of a second slide block 11, by way of brackets 12 and 12, which extends parallel to the first slide block 8, below the second spline shaft 13.

The second slide block 11 is thus allowed to extend forwardly relative to the stationary first slide block 8 in telescopic manner by way of the spline shafts 6 and 13 slidably supported by the bearings 9 and 9 and 10 and 10, respectively.

A rack gear 14 is securedly fixed to the upper surface of a side end of the second slide block 11 in parallel with the second spline shaft 13 and is meshed with a gear 16 of a motor 15 mounted on the upper surface of the front end of the support plate 5. Hence, the second slide block 11 can move in the fore and aft direction without any rotation over a distance close to its total length by being driven by the motor 15.

A suction device 17 is mounted on the front portion of the second slide block 11 and a suction head 18 in the front and an air conduit 19 on the rear, both extending laterally and mounted on the lower surface of the suction device 17, can be simultaneously moved vertically by a motor 20 mounted on the upper surface of the suction device 17.

A number of suction cups 21 are mounted on the lower surface of the suction head 18 in a single row extending laterally and a number of nozzles are connected to the air conduit 19 also in a single row extending parallel to the suction cups 21 so as to be directed downwardly toward the rear and to be on the same level as the suction cups 21 at their tips forwardly of the suction cups 21.

Each of the suction cups 21 is connected to a vacuum source not shown in the drawing by way of an electromagnetic valve which is also not shown in the drawing and are made to close sequentially from those on the right (in the sense of FIG. 1) through a pressure switch which is also not shown in the drawing, and the air conduit 19 is connected to an air source (not shown in the drawing) by way of an electromagnetic valve (not shown in the drawing).

Below the above-described device are located a sheet storage box 24 with an open top end for accommodating unprocessed sheet material 23 and another sheet storage box 26, with an open top end and of substantially same dimensions as the former sheet storage box 24, for accommodating processed sheet material 25. Both the sheet storage boxes 24 and 26 are adapted to be pulled sideways and the front end of the unprocessed sheet material 23 is located right under the suction cups 21.

A plurality of air holes 27 are provided in the bottom plate of the unprocessed sheet storage box 24 each right under each of the suction cups 21 for achieving a purpose which will be described hereinafter, and positioning stoppers 28 are provided at appropriate places in the front and the left ends of the bottom plate for positioning the unprocessed sheet material 23 when it is being stored.

The upper opening of the processed sheet storage box 26 is normally covered by a guide plate 29, which also serves as a light shield, having an upwardly bent front end.

A pair of racks 30 (only one of them is shown in FIG. 1) extending laterally and provided in the lower surface of the right and the left sides of the rear end of the guide plate 29 are meshed with gears 32 (only one of them is shown in FIG. 1) of a motor 31 and the guide plate 29 is adapted to be moved to the front by the motor 31.

Now the action of the device of this invention is described in the following with reference to FIGS. 2 to 5.

Figure 2:
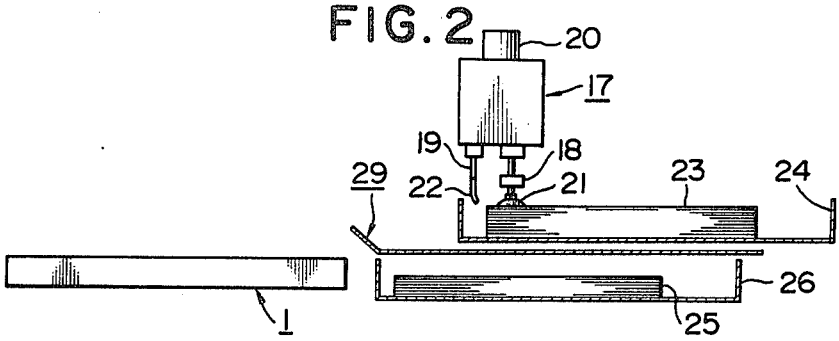
FIGS. 2 to 5 are side views of the same device for illustrating the action thereof.

In the device in the state shown in FIG. 2, the suction head 18 and the air conduit 19 are lowered with the motor 20 and each of the suction cups 21 is contacted to the upper surface of the left end of the unprocessed sheet material 23 before the unprocessed sheet material 23 is caught by suction.

At this moment, if the sheet material 23 is so small that some of the suction cups 21 on the right are off the sheet material 23, vacuum can not be built up in the suction cups 21 owing to the leakage of air from those suction cups 21 falling off the sheet material 23.

This is detected by the pressure switch and the suction to each of the suction cups 21 which suck in a large amount of air is relieved of its action by closing the electromagnetic valve associated therewith and the sheet material 23 is caught only by those suction cups 21 which are in contact with the sheet material 23.

The air holes 27 in the unprocessed sheet storage box 24 are provided for the purpose of preventing those suction cups 21 which fall off the sheet material 23 after their descent onto the bottom plate of the unprocessed sheet storage box 24 from building up vacuum upon direct contact with the bottom plate. It is also possible to have the sheet suction zone of the table of the automatic drafting machine be automatically determined upon setting up the suction positions of the suction cups 21.

When the vacuum build-up in the suction head 18 has risen to a sufficient level for complete catching of the sheet material 23 by suction, the motor 20 is reversed and the suction device 17 rises while the nozzles 22 of the air conduit 19 blow air onto the front end of the stack of sheet material 23 so that only the uppermost sheet material 23 may be taken up.

Figure 3:
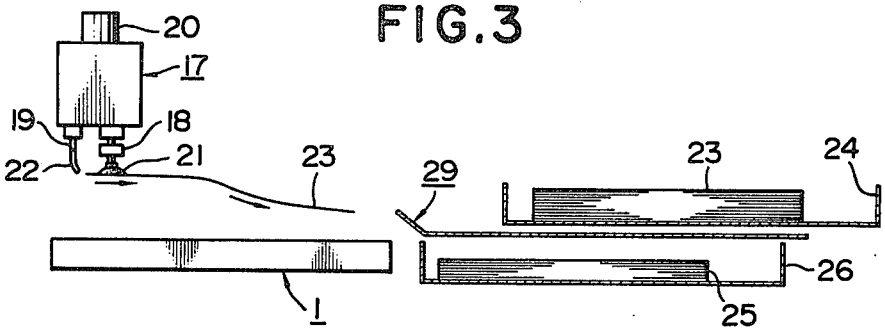

Next, as shown in FIG. 3, as the suction device 17 advances to above the vicinity of the near end of the table 1 of the automatic drafting machine through activation of the motor 15, the unprocessed sheet material 23 caught by the suction is conveyed over the table 1 while it is kept horizontally by the air flow from the nozzles 22. Then, after the suction head 18 and the air conduit 19 are lowered and the sheet material 23 is placed on the table 1, the sheet material is sucked onto the table 1.

Thereafter, the supply of suction to the suction head 18 and air to the air conduit 19 is terminated so that the suction device 17 releases the sheet material 23 and moves away from the table 1 so that the machine can draw patterns on the sheet material 23 left on the table 1.

Figure 4:
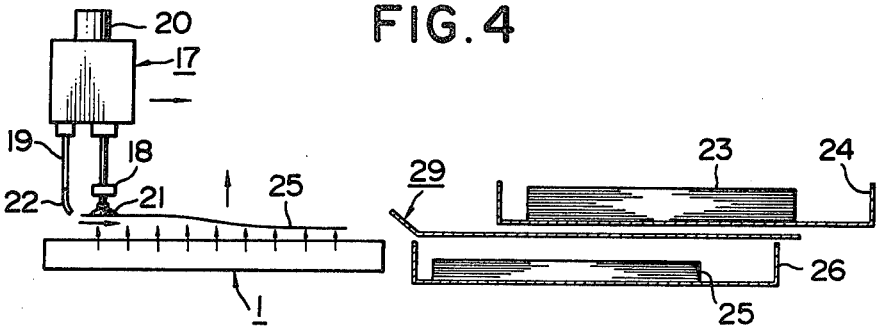

As shown in FIG. 4, upon completion of the drawing of patterns on the sheet material 23, the suction device 17 moves to above the near end of the processed sheet material 25 on the table 1 and the suction head 18 and the air conduit 19 come down to start suction and air flow supply, respectively. At this moment, since each of the suction cups 21 is activated in the same way as in the time of feeding the unprocessed sheet material 23, the whole surface of the processed sheet material 25 may be removed away from the table 1 by slightly raising the suction device 17 while letting air flow out from each of the air holes 2, contrary to the previous case.

Figure 5:
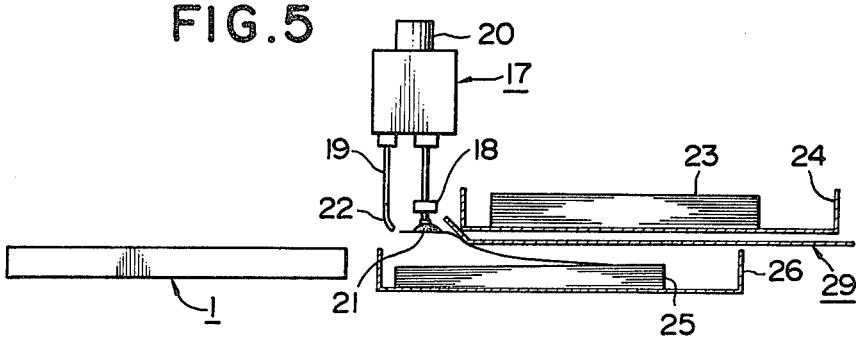

Next, the suction device 17 moves to the rear as shown in FIG. 5 followed by the activation of the motor 31 to move the guide plate 29 to the rear and open the front end of the processed sheet storage box 26, and the processed sheet material 25 moves to the rear maintaining the state shown in FIG. 4 to be ultimately guided by the guide plate 29 into the processed sheet storage box 26.

By stopping the suction device 17 at a preselected position and stopping the suction and the air flow supply at the same time, the processed sheet material 25 drops into the storage box 26 to be stored therein.

As can be clearly seen from the above description, the device of this invention can automatically feed and take out sheet material onto and from an automatic drafting machine or other sheet material processing machines without performing any modification to the existing automatic drafting machine or the like when it is used in connection therewith, offering the possibility of operating the automatic drafting machine or the like over a long time period without any human attendance.

Furthermore, since the device of this invention retains the normal paper, photosensitive paper, plastic sheet or the like in the process of feeding and taking out operations, with the suction cups 21 arranged in a row with the aid of the air flow from the nozzles 22 which are also arranged in a row parallel to the suction cup row, the sheet material conveying assembly can be made highly compact without any limitation imposed on the length of the sheet material to be handled in the conveying direction, producing the capability of handling the sheet material of an arbitrary length and assuring reliable sheet material handling operation without the risk of damaging the sheet material.

Moreover, the sheet material conveying assembly, the unprocessed storage box 24 and the processed sheet storage box 26, all have substantially the same horizontal dimensions and are laid over one another. The overall structure may thus be made highly compact, occupying very little floor space.

Also, since there is no rail or the like for conveying the sheet material around the circumference of the sheet processing machine, the operation of the sheet processing machine is no way hindered by the sheet handling device and the device of this invention may be placed beside the sheet processing machine without making any modification to the machine of a standard type. Hence, the operating efficiency of the sheet processing machine is no way damaged by the sheet handling device of this invention.

Although the above-described embodiment was related to a case in which the device of this invention was installed in association with an automatic drafting machine, it is obvious to a person skilled in the art that the device of this invention may be applied to automatic feeding and taking out of sheet material of almost any kind onto and from a table of a sheet processing machine which is located nearby, and to automatic feeding and taking out of sheet material in general.

In the above-described embodiment, the upper opening of the processed sheet material storage box 26 was normally covered by the guide plate 29 which is slidable sideways, but, when the sheet material 23 is normal paper or the like which is not photosensitive, an appropriate means may be provided on the front end of the unprocessed sheet material storage box 24 for guiding the processed sheet material 25 which is to be released downwardly.

What is claimed is:

1. A sheet material handling device for feeding and taking out sheet material onto and from a work table, comprising:

an unprocessed sheet material storage box with an open top end located beside the work table;

a processed sheet material storage box with an open top end located below the unprocessed sheet material storage box nearer to the work table than the unprocessed sheet material storage box is; and a suction device including a suction head which is adapted to reciprocate between a position above the work table and another position above the unprocessed sheet material storage box and to move up and down at these two positions and has an appropriate number of suction cups on the lower surface thereof for holding the work table side end of the unprocessed sheet material and an air conduit which is adapted to move integrally with the suction cups and has an appropriate number of air nozzles located nearer to the table than the suction cups are and inclined downwardly toward the suction cups to have their tips at substantially same level as the tips of the suction cups, the air flow from the nozzles guiding the sheet material when it is being conveyed.

2. A sheet material handling device according to claim 1, wherein the suction device is supported on a fixed member by a telescopically extendible cantilever arm.

3. A sheet material handling device for feeding and taking out material onto and from a work table, comprising:

an unprocessed sheet material storage box with an open top end located beside the work table;

a processed sheet material storage box with an open top end located below the unprocessed sheet material storage box nearer to the work table than the unprocessed sheet material storage box is; and a suction device including a suction head which is adapted to reciprocate between a position above the work table and another position above the unprocessed sheet material storage box and to move up and down at these two positions and has an appropriate number of suction cups on the lower surface thereof for holding the work table side end of the unprocessed sheet material and an air conduit which is adapted to move integrally with the suction cups and has an appropriate number of air nozzles located nearer to the table than the suction cups are and inclined downwardly toward the suction cups to have their tips at substantially same level as the tips of the suction cups, the air flow from the nozzles guiding the sheet material when it is being conveyed;

the said suction device being supported on a fixed member by a telescopically extendible cantilever arm;

the telescopically extendible arm being comprised of a first spline shaft fixedly secured to the fixed member, a first slide block receiving the first spline shaft with a linear bearing, a second spline shaft slidably received by the first slide block by way of another linear bearing and a second slide block which is fixedly secured to the second spline shaft and supports the suction device.

4. A sheet material handling device according to claim 3, wherein the suction head has a plurality of suction cups arranged in a row on the lower surface thereof and the unprocessed sheet material is placed so that an end of the suction cup row coincide with a side end portion of the unprocessed sheet material, and the suction cups are adapted to be cut off from suction one by one from those nearer to the other end of the suction cup row in sequential manner until enough vacuum is built up in those suction cups falling upon the unprocessed sheet material with the bottom plate of the unprocessed sheet material storage box provided with air passage holes at positions right under the suction cups.

5. A sheet material handling device according to claim 4, wherein a guide plate is provided over the processed sheet material storage box to serve as a light shield which may be moved sideways to open an end of the upper opening of the unprocessed sheet material storage box on the side of the work table in addition to as a guide for guiding the processed sheet material into the processed sheet material storage box.

* * * * *